US006994096B2

(12) United States Patent
Rostami et al.

(10) Patent No.: US 6,994,096 B2
(45) Date of Patent: Feb. 7, 2006

(54) FLOW DISTRIBUTOR OF AN ELECTRICALLY HEATED CIGARETTE SMOKING SYSTEM

(75) Inventors: Ali A. Rostami, Glen Allen, VA (US); Susan E. Wrenn, Ashland, VA (US)

(73) Assignee: Philip Morris USA Inc., Richmond, VA (US)

( * ) Notice: Subject to any disclaimer, the term of this patent is extended or adjusted under 35 U.S.C. 154(b) by 351 days.

(21) Appl. No.: 10/353,923

(22) Filed: Jan. 30, 2003

(65) Prior Publication Data

US 2004/0149296 A1 Aug. 5, 2004

(51) Int. Cl.
*A24F 5/04* (2006.01)

(52) U.S. Cl. ..... 131/195; 131/194; 131/329

(58) Field of Classification Search ..... 131/194, 131/195, 329
See application file for complete search history.

(56) References Cited

U.S. PATENT DOCUMENTS 5,060,671 A 10/1991 Counts et al.
5,093,894 A 3/1992 Deevi et al.
5,095,921 A 3/1992 Losee et al.
5,225,498 A 7/1993 Sorathia et al.
5,388,594 A 2/1995 Counts et al.
5,499,636 A 3/1996 Baggett et al.
5,591,368 A 1/1997 Fleischhauer et al.
5,878,752 A 3/1999 Adams et al.
2004/0089314 A1 * 5/2004 Felter et al. ..... 131/194

OTHER PUBLICATIONS

Notification of Transmittal of the International Search Report or the Declaration for PCT/US04/02545 dated Aug. 20, 2004.
Written Opinion for PCT/US04/02545 dated Aug. 20, 2004.

* cited by examiner

*Primary Examiner*—Dionne A. Walls
(74) *Attorney, Agent, or Firm*—Buchanan Ingersoll PC

(57) ABSTRACT

A heater fixture for use in an electrically heated cigarette smoking system having a source of electrical energy for heating a cigarette includes an inner wall or barrel having at least one opening through the inner wall extending from an outer peripheral surface to an inner surface of the inner wall, and at least one flow distributing element positioned within the at least one opening and extending inwardly from the inner surface. The flow distributing element or elements are provided with a plurality of openings that are in fluid communication with an interior of the heater.

14 Claims, 5 Drawing Sheets

Side view

View A-A

FLOW DISTRIBUTOR OF AN ELECTRICALLY HEATED CIGARETTE SMOKING SYSTEM

FIELD OF THE INVENTION

The present invention relates to a heater for use in an electrically heated cigarette smoking system.

BACKGROUND OF THE INVENTION

Previously known conventional lit cigarettes deliver flavor and aroma to the user as a result of combustion of tobacco. A mass of combustible material, primarily tobacco, is oxidized as the result of applied heat with typical combustion temperatures in a conventional cigarette being in excess of 800 degrees Celsius during puffing.

Lit-end cigarettes have some perceived drawbacks associated with them. Among them is the production of side stream smoke during smoldering between puffs, which may be objectionable to some non-smokers. Also, once lit, lit-end cigarettes must be fully consumed or discarded. Relighting a lit-end cigarette is possible but is usually an unattractive prospect for subjective reasons related to flavor, taste and odor.

Electrical smoking systems including electrically powered lighters and specially designed cigarettes that are adapted to cooperate with the lighters are disclosed in several commonly assigned U.S. patents, including U.S. Pat. Nos. 5,591,368, 5,878,752, 5,093,894, 5,225,498, 5,060,671, 5,095,921, 5,388,594 and 5,499,636, each of which is incorporated herein by reference.

In an embodiment of the lighter of U.S. Pat. No. 5,878,752, as shown in FIGS. 1 and 2, the smoking system 21 includes a cylindrical cigarette 23 and a reusable, hand-held lighter 25. The cigarette 23 is adapted to be inserted and removed from an orifice 27 at a front end 29 of the lighter 25. The cigarette 23 is disposed of after one or more puff cycles. The lighter 25 is preferably disposed of after a greater number of puff cycles than the cigarette 23. The lighter 25 includes a housing 31 and has front and rear portions 33 and 35. A power source 37 for supplying energy to heater elements 120 for heating the cigarette 23 is preferably disposed in the rear portion 35 of the lighter 25. The rear portion 35 is preferably adapted to be easily opened and closed, such as with screws or with snap-fit components, to facilitate replacement of the power source 37. The front portion 33 preferably houses heater elements and circuitry in electrical communication with a power source 37 in the rear portion 35. The housing 31 is preferably adapted to fit comfortably in the hand of a smoker and, in a presently preferred embodiment, has overall dimensions of approximately 10.7 cm×3.8 cm×1.5 cm. The power source 37 is sized to provide sufficient power for heater elements that heat the cigarette 23. The power source 37 is preferably replaceable and rechargeable and may include devices such as a capacitor, or more preferably, a battery. A substantially cylindrical heater fixture 39 for heating the cigarette 23, and, preferably, for holding the cigarette in place relative to the lighter 25, and electrical control circuitry 41 for delivering a predetermined amount of energy from the power source 37 to cigarette heater elements 120 of the heater fixture 39, are preferably disposed in the front 33 of the lighter.

The plurality of metallic heaters 120 are disposed in a configuration that slidingly receives a tobacco rod portion of a cigarette. One of the many advantages of such a smoking system is the reusability of the lighter for numerous cigarettes. In the heater fixture disclosed in U.S. Pat. No. 5,878,752 and shown in FIGS. 1 and 2, a cigarette would be inserted through the tapered opening at the right side of FIG. 2 into a substantially cylindrical space of the cigarette heater fixture defined by a ring-shaped cap 83 having an open end for receiving the cigarette, a cylindrical air channel sleeve 87, an outer sleeve 84, a heater assembly including the heater blades 120, and electrically conductive pins or leads 104A and 104B. The spacer 49 stops the cigarette in a desired position in the cigarette heater fixture such that the heater blades 120 are disposed in a snug fit around the outer circumference of the cigarette. The heater fixture disclosed in U.S. Pat. No. 5,878,752 shows an air channel sleeve 87 through which air can flow axially in order to reach the point where the heater blades 120 contact the cigarette. Gaps 125, 126 and 130 can provide pathways for the air to be drawn into contact with the inserted cigarettes.

SUMMARY OF THE INVENTION

An embodiment according to the present invention provides a desirable improvement in air flow distribution to heater blades of an electrical smoking system, which results in an increase of the total aerosol delivery of the system.

In a modification of the heater disclosed in U.S. Pat. No. 5,878,752, the air flow channel sleeve 87 can be eliminated and air directed to the heater blades through radial holes in the sleeve 200. Air can reach the outside of sleeve 200 after passing through an opening or openings in the housing 31 of the lighter 25. Although not shown in FIG. 1, such openings would typically be provided through the housing 31 at the front 33 of the lighter 25. It has been discovered that side holes through the sleeve surrounding the heater blades may result in channeling of the air flow over a limited area of the heater. With limited air flow to the heater blades and the cigarette, the pyrolysis of the cigarette is also limited and the total particulate matter produced in the generated aerosol is restricted. Accordingly, limitations in the air flow to the heater blades can result in the heater failing to produce sufficient aerosol to provide a smoker with the desired flavors and aromas.

A heater fixture for use in a smoking system having a source of electrical energy for heating a cigarette according to an embodiment of the invention includes an inner wall, said inner wall having at least one opening through the wall extending from an outer peripheral surface to an inner surface of the wall, and at least one flow distributing element positioned within said at least one opening and extending inwardly from the inner surface. The at least one flow distributing element includes a plurality of openings that are in fluid communication with an interior of the heater fixture. A plurality of heater elements are arranged in the interior of the heater fixture within the inner wall, and fit snugly around the outer circumference of a cigarette inserted into the heater fixture. The openings from the flow distributing element into the interior of the heater fixture extend radially outward from the central axis of each flow distributing element and ensure that the air flow will be mixed within the heater fixture as the air is directed in different directions through the holes from the flow distributing element.

DETAILED DESCRIPTION OF PREFERRED EMBODIMENTS

Figure 1:
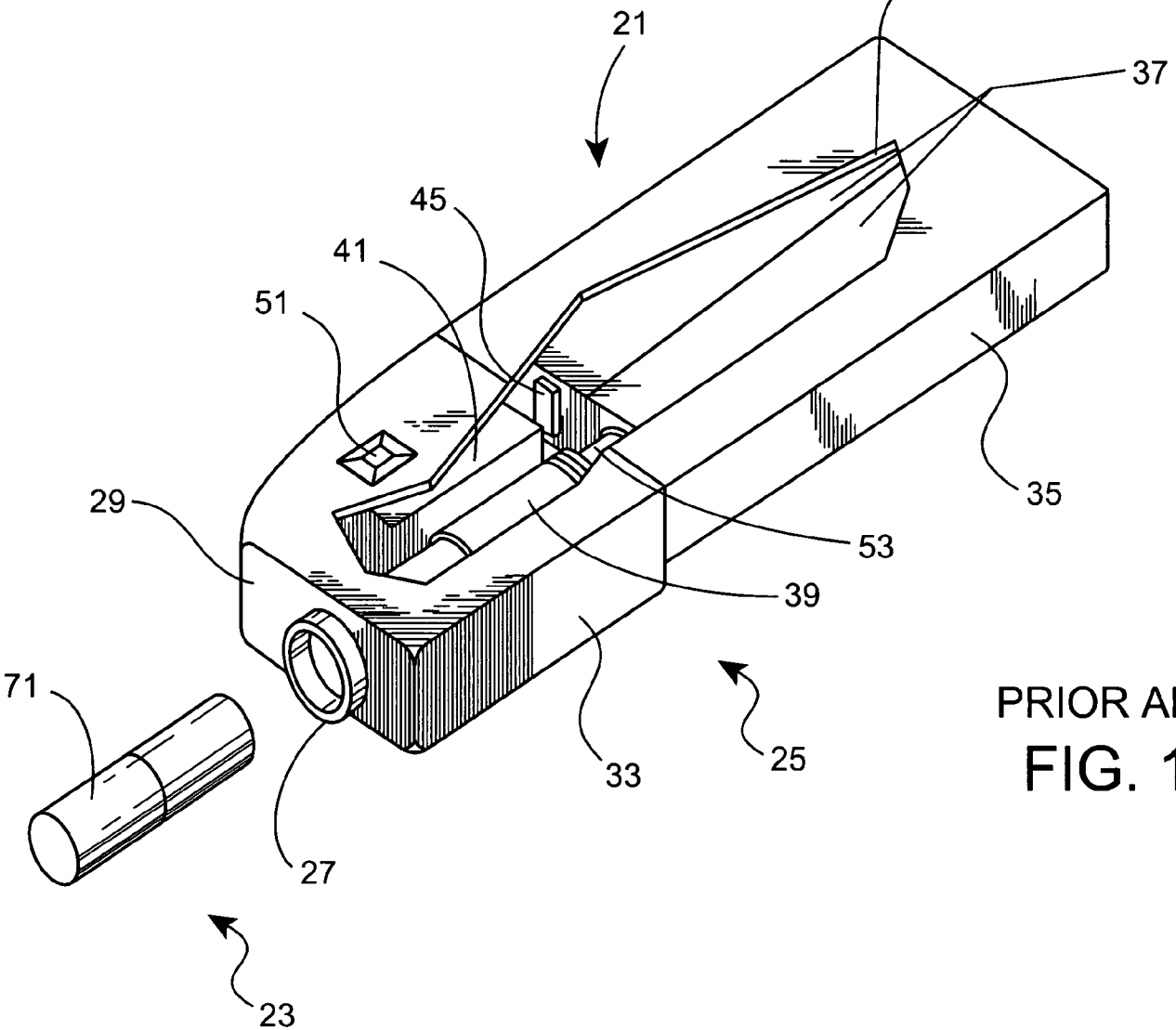
PRIOR ART FIG. 1
FIG. 1 is a perspective view of an electrical lighter.
Figure 2:
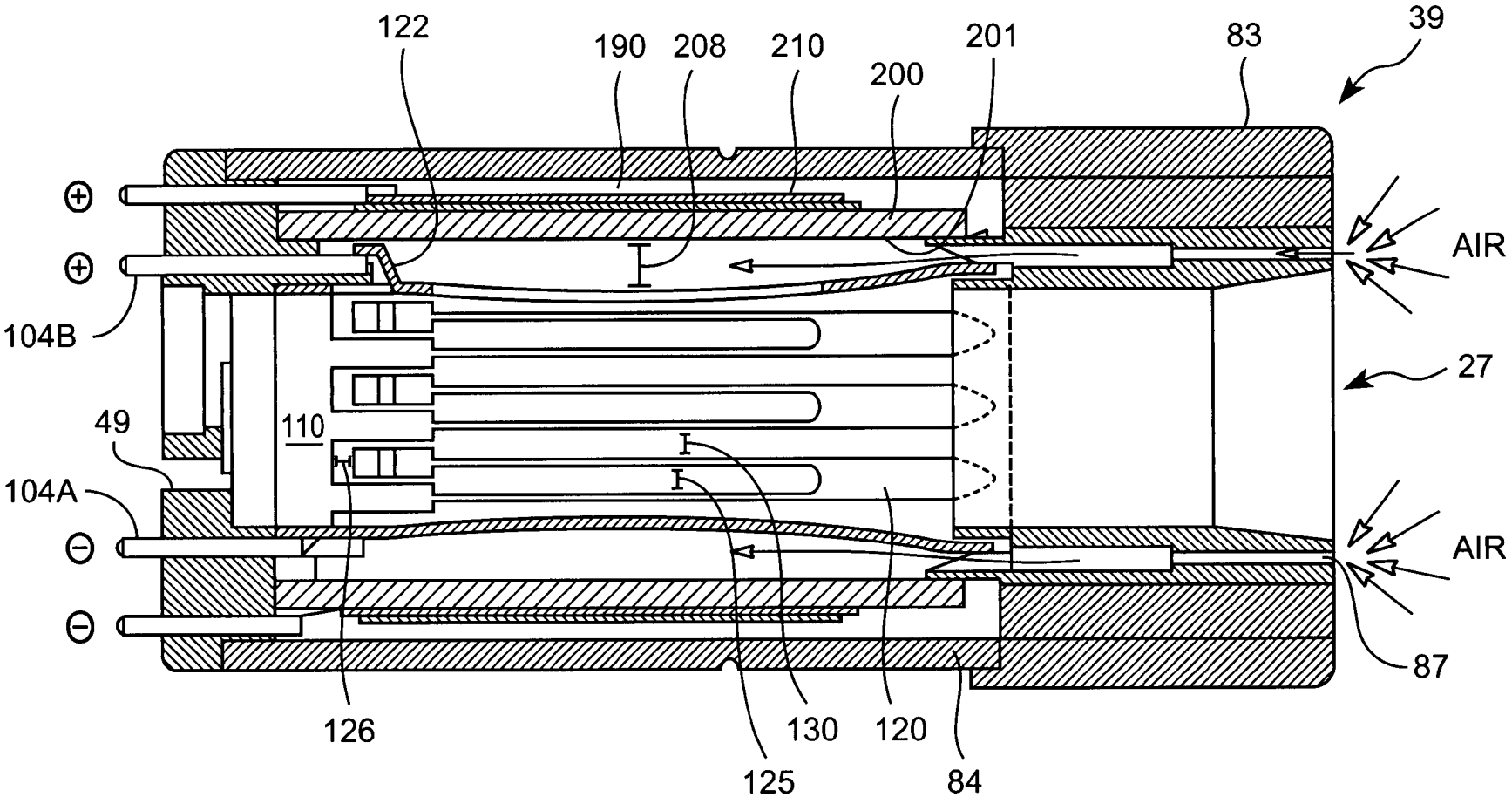
FIG. 2 illustrates a side cross-sectional view of a heater fixture surrounded by an inner barrel or sleeve and associated heater element.

A heater fixture of an electrical smoking system having improved air flow is described below. Electrically heated cigarette smoking systems are described in greater detail in U.S. Pat. Nos. 5,388,594 and 5,878,752, which are hereby incorporated by reference in their entireties. The fixture used in the electrically heated cigarette smoking systems described in the above patents is shown in FIGS. 1 and 2 of the present application. A specially designed cigarette is adapted to be inserted in and removed from an orifice 27 at a front end of the heater fixture 39. The heater fixture 39 is preferably substantially cylindrical, and holds a cigarette in place relative to the electrically heated cigarette smoking system in which the heater fixture is supported. Electrical control circuitry can also be provided within the electrically heated cigarette smoking system for delivering a predetermined amount of energy from a power source to the cigarette heater elements 120, shown in FIG. 2. A generally circular, terminal end hub 110 is fixed, e.g., welded, to be disposed within the interior of the cigarette heater fixture 39, e.g., is fixed to a spacer 49, as shown in FIG. 2.

The heater fixture 39 includes a plurality of radially spaced heater blades 120 supported to extend from the hub 110, as shown in FIG. 2. The heater blades 120 are individually energized by a power source under the control of electrical circuitry (not shown).

The heater elements 120 can comprise any suitable heater element for heating tobacco to evolve tobacco flavors. For example, the heating system can comprise any of the resistance and induction heating systems disclosed in the above-referenced patents.

A cigarette is inserted in the orifice 27 of the heater fixture 39, and into a substantially cylindrical space of the heater fixture 39 defined by a ring-shaped cap 83 having an open end for receiving the cigarette, and a cylindrical sleeve 87, such as shown in FIG. 1 except that the axial air passageways shown in FIG. 1 are no longer provided in an embodiment according to the invention. The heater fixture 39 also can include an outer surface or barrel, which preferably also forms the outer housing 31 of the lighter 25, a heater assembly including the heater blades 120, electrically conductive pins or common leads 104A, 104B, which serve as common leads for the heater elements of the heater assembly, and the spacer 49, to which the terminal end hub 110 is fastened.

Figure 5:
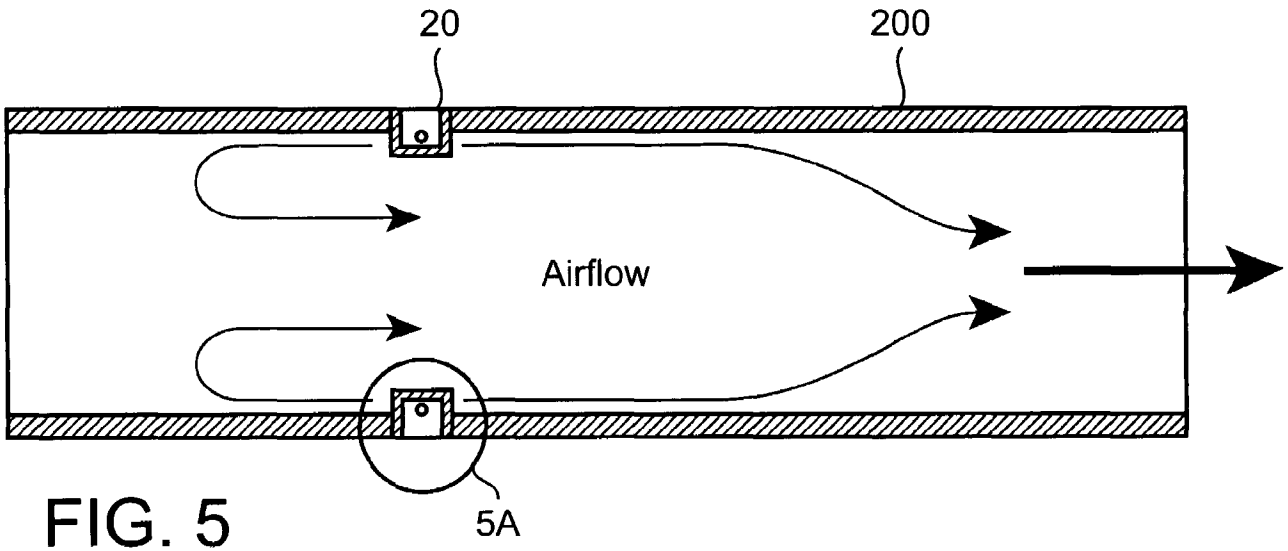
FIG. 5 and the enlarged view in FIG. 5A illustrate the inner barrel of FIG. 2 modified to include two flow distributing elements according to an embodiment of the invention placed through the side holes.
Figure 5A:
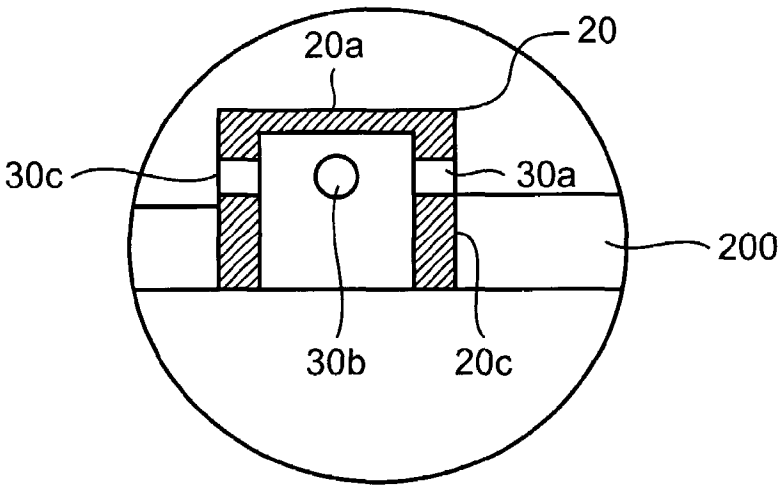
Figure 6:
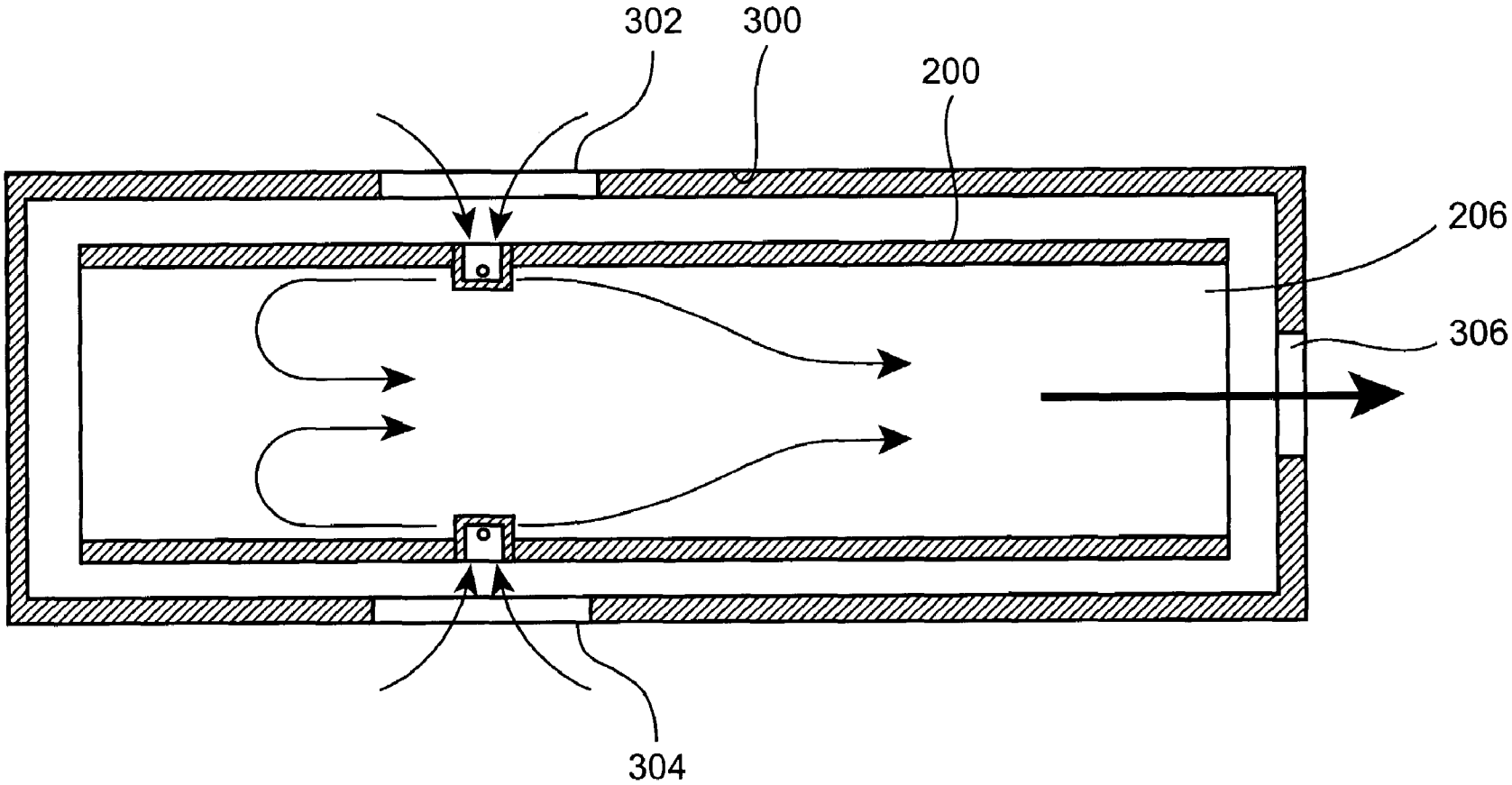
FIG. 6 illustrates a side cross-sectional view of an inner barrel for a heater having flow distributing elements according to an embodiment of the invention and an outer barrel having openings positioned radially outward from the flow distributing elements.

The heater fixture 39 according to an embodiment of the present invention, as shown in FIG. 5, comprises an inner cylindrical sleeve or barrel 200 concentrically surrounding the heater blades 120 that is provided with openings through which flow distributing elements 20, shown more clearly in FIG. 5A, are inserted. As shown in FIG. 6, the inner barrel or sleeve 200 is concentrically surrounded by an outer barrel or sleeve 300, that is also provided with openings 302 and 304, which are preferably placed approximately radially outward from the openings in the inner barrel or sleeve 200. The outer barrel or sleeve 300 preferably forms the outside of the lighter 25, or housing 31 shown in FIG. 1.

It has been found that a primarily transverse or radial air flow relative to the inserted cigarette results in a more desirable aerosol flow radially inward from the cigarette heater blades. Flow distributing elements 20 shown inserted through side holes in the inner barrel 200 in FIGS. 5, 5A and 6, and shown in detail in FIGS. 3A and 3B, help to ensure that air flow entering the inner barrel 200 is distributed evenly amongst the heater blades within the inner barrel 200.

Figure 3A:
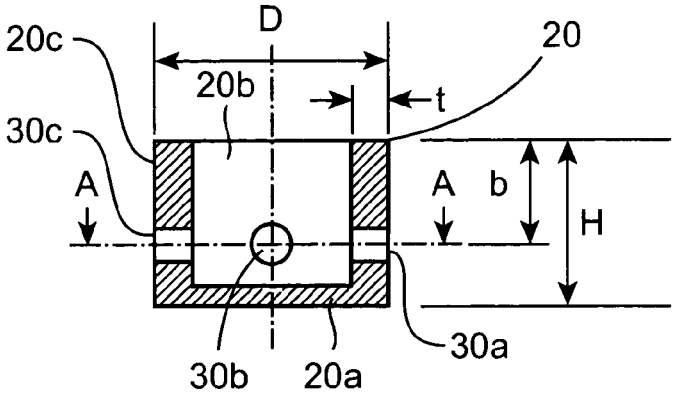
FIG. 3A illustrates a side cross-sectional view through a flow distributing element according to an embodiment of the invention.
Figure 3B:
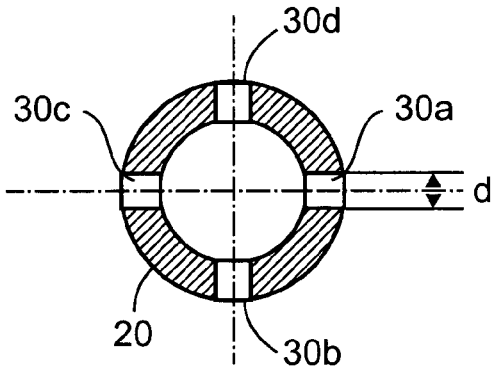
FIG. 3B is a cross-sectional view taken in the direction of arrows A—A in FIG. 3A of a flow distributing element according to an embodiment of the invention.
Figure 4:
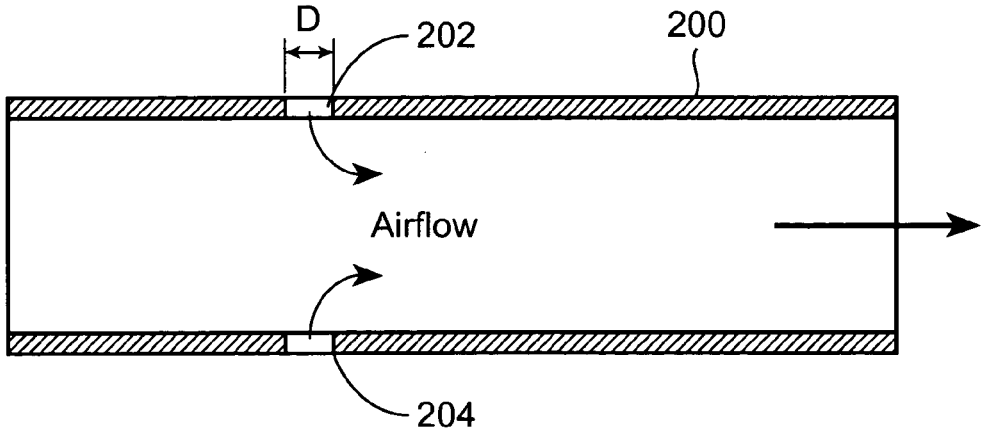
FIG. 4 illustrates an inner barrel or sleeve for the heater in an electrically heated cigarette smoking system and having two side holes through the barrel to provide air flow into the heater.

As shown in FIGS. 3A and 3B, a flow distributor 20 is substantially a hollow, closed-end cylinder with four holes through its wall 20*c* near the closed end of the cylinder. The holes 30*a*, 30*b*, 30*c*, and 30*d* can be located through the wall 20*c* of the flow distributing element near the closed end 20*a* of flow distributing element 20 and distributed evenly around the circumference of the flow distributing element. In the embodiment shown in FIG. 3B, the holes are located 90 degrees apart, although other alternate configurations are possible and contemplated within the scope of the invention.

As shown in FIGS. 5 and 5A, two flow distributing elements protrude through the side walls of the inner barrel or sleeve 200, spaced 180 degrees from each other, and extend radially inward toward the interior of the heater fixture. The openings 30*a*, 30*b*, 30*c*, 30*d* are positioned in the interior of the inner sleeve 200 such that air flowing through the flow distributing elements 20 is distributed more uniformly inside the heater fixture 39. The openings shown in FIG. 3B force air to be channeled in four different directions as it exits from the flow distributing element 20 into the interior of the inner sleeve 200.

An outer barrel or sleeve 300 preferably forms the outer housing of the lighter, concentrically surrounds the inner sleeve 200, and is provided with openings 302, 304 that are preferably positioned radially outward from the location of the flow distributing elements 20 through inner sleeve 200. Ambient air on the outside of the outer barrel 300 enters through the openings 302, 304 and is directed into the flow distributing elements 20 when a smoker draws upon a cigarette inserted within the heater fixture 39. The outer barrel or sleeve 300 preferably forms the outer housing of the lighter containing the heater fixture 39, such that openings 302, 304 open to the outside, ambient air.

The improved air flow that is caused by air entering into the space around heater blades 120 after being distributed by passage through the flow distributing element 20 results in an increase in the total delivery of aerosol caused by the heating of the cigarette inserted within heater blades 120. The improvement in delivery of total particulate matter caused by the heating of tobacco in proximity to heater blades 120 has been measured to be approximately 10% greater than the total particulate matter delivered by a heater fixture 39 that does not include the advantage of the flow distributing elements 20 for better air flow distribution to and around the heater blades 120.

Many modifications, substitutions and improvements may be apparent to the skilled artisan without departing from the spirit and scope of the present invention as described in and defined herein and in the following claims. In particular, the number of openings through the flow distributing element wall is not limited to four and the openings can be distributed at circumferential positions around the distributing element other than at 90 degrees. Additionally, although two flow distributing elements 20 are shown at approximately 180 degrees from each other through the wall of inner sleeve 200, the number of flow distributing elements can vary as well as their locations through the wall of the inner sleeve or barrel 200.

While this invention has been described in conjunction with the exemplary embodiments outlined above, many alternatives, modifications and variations will be apparent to those skilled in the art. Accordingly, the exemplary embodiments of the invention may be made without departing from the spirit and scope of the invention.

What is claimed is:

1. A heater fixture of an electrical smoking system, the heater fixture comprising;

an inner wall, said inner wall having at least one opening through the inner wall extending from an outer peripheral surface to an inner surface of the inner wall;

at least one flow distributing element positioned within said at least one opening and extending inwardly from said inner surface, said flow distributing element having a plurality of openings in fluid communication with an interior of said heater fixture; and at least one heater element arranged in the interior of said heater fixture within said inner wall.

2. The heater fixture according to claim 1, wherein said inner wall is cylindrical and two of said flow distributing elements extend through said inner wall approximately 180 degrees apart from each other.

3. The heater fixture according to claim 2, wherein each of said flow distributing elements extends into said interior of said heater fixture along an axis that is approximately perpendicular to a central axis of said heater, and said openings in each of said flow distributing elements extend radially outward from said axis of each of said flow distributing elements.

4. The heater fixture according to claim 3, wherein each of said flow distributing elements has four of said openings extending radially outward from the axis of the flow distributing element.

5. The heater fixture according to claim 4, wherein two of said openings in each flow distributing element extend in a direction approximately parallel to the central axis of the heater fixture, and two of said openings in each flow distributing element extend in a direction approximately perpendicular to the central axis of the heater fixture.

6. The heater fixture according to claim 1, further including an outer wall around said inner wall.

7. The heater fixture according to claim 6, wherein said outer wall is provided with at least one through hole.

8. The heater fixture according to claim 7, wherein the outer wall is a substantially cylindrically-shaped wall around the inner wall, and one of said at least one through holes is provided approximately radially outward from each of said at least one flow distributing element.

9. The heater fixture according to claim 8, wherein air flow passes through each of said through holes in said outer wall and enters each of said flow distributing elements to be distributed to said at least one heater element through said openings in said flow distributing elements.

10. The heater fixture according to claim 9, wherein said inner wall is cylindrical and two of said flow distributing elements extend through said inner wall approximately 180 degrees apart from each other.

11. The heater fixture according to claim 10, wherein each of said flow distributing elements extends into said interior of said heater fixture along an axis that is approximately perpendicular to a central axis of said heater fixture, and said openings in each of said flow distributing elements extend radially outward from said axis of each of said flow distributing elements.

12. The heater fixture according to claim 11, wherein each of said flow distributing elements has four of said openings extending radially outward from the axis of the flow distributing element.

13. The heater fixture according to claim 12, wherein two of said openings in each flow distributing element extend in a direction approximately parallel to the central axis of the heater fixture, and two of said openings in each flow distributing element extend in a direction approximately perpendicular to the central axis of the heater fixture.

14. A smoking system comprising a lighter and a cigarette, said lighter including a heater fixture according to any one of claims 1–13.

* * * * *